US010336090B2

(12) United States Patent
Govyadinov et al.

(10) Patent No.: US 10,336,090 B2
(45) Date of Patent: Jul. 2, 2019

(54) CIRCULATION IN A FLUID EJECTION DEVICE

(71) Applicant: Hewlett-Packard Development Company, L.P., Houston, TX (US)

(72) Inventors: Alexander Govyadinov, Corvallis, OR (US); Craig Olbrich, Corvallis, OR (US); Brian M. Taff, Portland, OR (US)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/921,614

(22) Filed: Mar. 14, 2018

(65) Prior Publication Data

US 2018/0201024 A1 Jul. 19, 2018

Related U.S. Application Data

(63) Continuation of application No. 15/433,827, filed on Feb. 15, 2017, now Pat. No. 9,969,177, which is a continuation of application No. 15/252,433, filed on Aug. 31, 2016, now Pat. No. 9,623,659, which is a continuation of application No. 14/958,022, filed on (Continued)

(51) Int. Cl.

| | |
|---|---|
| ***B41J 2/175*** | (2006.01) |
| ***B41J 2/14*** | (2006.01) |
| ***B41J 2/15*** | (2006.01) |

(52) U.S. Cl.

CPC ..... *B41J 2/17596* (2013.01); *B41J 2/1404* (2013.01); *B41J 2/1433* (2013.01); *B41J 2/14145* (2013.01); *B41J 2/15* (2013.01); *B41J 2/175* (2013.01); *B41J 2002/14387* (2013.01); *B41J 2002/14467* (2013.01); *B41J 2202/12* (2013.01)

(58) Field of Classification Search

CPC .. B41J 2/1404; B41J 2/14145; B41J 2/14233; B41J 2/1433; B41J 2/15; B41J 2/161; B41J 2/162; B41J 2/175; B41J 2/17596; B41J 2002/012; B41J 2002/14387; B41J 2002/14467; B41J 2202/12

See application file for complete search history.

(56) References Cited

U.S. PATENT DOCUMENTS

| | | | |
|---|---|---|---|
| 4,480,259 | A | 10/1984 | Kruger |
| 5,087,930 | A | 2/1992 | Roy |

(Continued)

FOREIGN PATENT DOCUMENTS

| | | | |
|---|---|---|---|
| JP | 2001205810 | A | 7/2001 |
| JP | 2001205810 | A | 7/2001 |

(Continued)

*Primary Examiner* — Anh T Vo

(74) *Attorney, Agent, or Firm* — HP Inc. Patent Department

(57) ABSTRACT

A fluid ejection device may include a discharge port, an energy generating element to discharge liquid through the discharge port, a first liquid supply on a first side of the discharge port, a second liquid supply on a second side of the discharge port opposite the first side, a first liquid flow path extending from the first liquid supply to the discharge port, a second liquid flow path extending from the second liquid supply to the discharge port and a fluid displacement actuator in the first liquid flow path.

20 Claims, 10 Drawing Sheets

Related U.S. Application Data

Dec. 3, 2015, now Pat. No. 9,457,584, which is a continuation of application No. 14/241,330, filed as application No. PCT/US2011/053619 on Sep. 28, 2011, now Pat. No. 9,211,721.

(56) References Cited

U.S. PATENT DOCUMENTS

| | | | | |
|---|---|---|---|---|
| 5,818,485 | A | 10/1998 | Rezanka | |
| 6,132,034 | A | 10/2000 | Miller | |
| 6,139,761 | A | 10/2000 | Ohkuma | |
| 6,244,694 | B1 | 6/2001 | Weber et al. | |
| 6,409,312 | B1 | 6/2002 | Mrvos et al. | |
| 6,718,632 | B2 | 4/2004 | Liu et al. | |
| 6,843,121 | B1 | 1/2005 | DeBar et al. | |
| 6,880,926 | B2 | 4/2005 | Childs et al. | |
| 6,981,759 | B2 | 1/2006 | Chen et al. | |
| 7,175,255 | B2 | 2/2007 | Okito et al. | |
| 7,271,105 | B2 * | 9/2007 | Krawczyk | B41J 2/1603 216/2 |
| 7,300,596 | B2 | 11/2007 | Murayama et al. | |
| 7,438,392 | B2 | 10/2008 | Vaideeswaran et al. | |
| 7,600,858 | B2 | 10/2009 | Barnes et al. | |
| 7,850,290 | B2 | 12/2010 | Nitta et al. | |
| 8,113,628 | B2 | 2/2012 | Xie | |
| 8,182,073 | B2 | 5/2012 | Xie | |
| 8,469,494 | B2 | 6/2013 | Xie | |
| 8,517,518 | B2 | 8/2013 | Kashu | |
| 8,573,758 | B2 | 11/2013 | Inoue et al. | |
| 8,757,783 | B2 * | 6/2014 | Govyadinov | B41J 2/1404 347/67 |
| 10,040,292 | B2 * | 8/2018 | Okushima | B41J 2/175 |
| 2008/0238980 | A1 | 10/2008 | Nagashima | |
| 2010/0072414 | A1 | 3/2010 | Kwon | |
| 2010/0238238 | A1 | 9/2010 | Yamamoto | |
| 2010/0321443 | A1 | 12/2010 | Xie | |
| 2011/0228012 | A1 | 9/2011 | Yoshida | |

FOREIGN PATENT DOCUMENTS

| | | |
|---|---|---|
| JP | 2004249741 | 9/2004 |
| JP | 2005279784 | 10/2005 |
| JP | 2008-254199 | 10/2008 |
| JP | 2010-201734 | 9/2010 |
| JP | 2010201734 A | 9/2010 |
| JP | 2010221443 A | 10/2010 |

* cited by examiner

CIRCULATION IN A FLUID EJECTION DEVICE

CROSS REFERENCE TO RELATED APPLICATIONS

The present application is a continuation application claiming priority under 35 USC § 120 from co-pending U.S. patent application Ser. No. 15/433,827 filed on Feb. 15, 2017 which is a continuation of U.S. patent application Ser. No. 15/252,433 filed on Aug. 31, 2016 and issued as U.S. Pat. No. 9,623,659 on Apr. 18, 2017, which is a continuation of U.S. patent application Ser. No. 14/958,022 filed on Dec. 3, 2015 and issued as U.S. Pat. No. 9,457,584 on Oct. 4, 2016, which is a continuation of U.S. patent application Ser. No. 14/241,330 filed on Feb. 26, 2014 and issued as U.S. Pat. No. 9,211,721 on Dec. 15, 2015, which is a national application filed under 37 CFR 371 and claiming party from PCT/US2011/05361 filed on Sep. 28, 2011.

BACKGROUND

Fluid ejection devices in inkjet printers provide drop-on-demand ejection of fluid drops. Inkjet printers produce images by ejecting ink drops through a plurality of nozzles onto a print medium, such as a sheet of paper. The nozzles are typically arranged in one or more arrays, such that properly sequenced ejection of ink drops from the nozzles causes characters or other images to be printed on the print medium as the printhead and the print medium move relative to each other. In a specific example, a thermal inkjet printhead ejects drops from a nozzle by passing electrical current through a heating element to generate heat and vaporize a small portion of the fluid within a firing chamber. Some of the fluid displaced by the vapor bubble is ejected from the nozzle. In another example, a piezoelectric inkjet printhead uses a piezoelectric material actuator to generate pressure pulses that force ink drops out of a nozzle.

Although inkjet printers provide high print quality at reasonable cost, their continued improvement depends in part on overcoming various operational challenges. For example, the release of air bubbles from the ink during printing can cause problems such as ink flow blockage, insufficient pressure to eject drops, and mis-directed drops. Pigment-ink vehicle separation (PIVS) is another problem that can occur when using pigment-based inks. PIVS is typically a result of water evaporation from ink in the nozzle area and pigment concentration depletion in ink near the nozzle area due to a higher affinity of pigment to water. During periods of storage or non-use, pigment particles can also settle or crash out of the ink vehicle which can impede or block ink flow to the firing chambers and nozzles in the printhead. Other factors related to "decap", such as evaporation of water or solvent can cause PIVS and viscous ink plug formation. Decap is the amount of time inkjet nozzles can remain uncapped and exposed to ambient environments without causing degradation in the ejected ink drops. Effects of decap can alter drop trajectories, velocities, shapes and colors, all of which can negatively impact the print quality of an inkjet printer.

BRIEF DESCRIPTION OF THE DRAWINGS

The present embodiments will now be described, by way of example, with reference to the accompanying drawings, in which.

DETAILED DESCRIPTION

Overview of Problem and Solution

Figure 1:
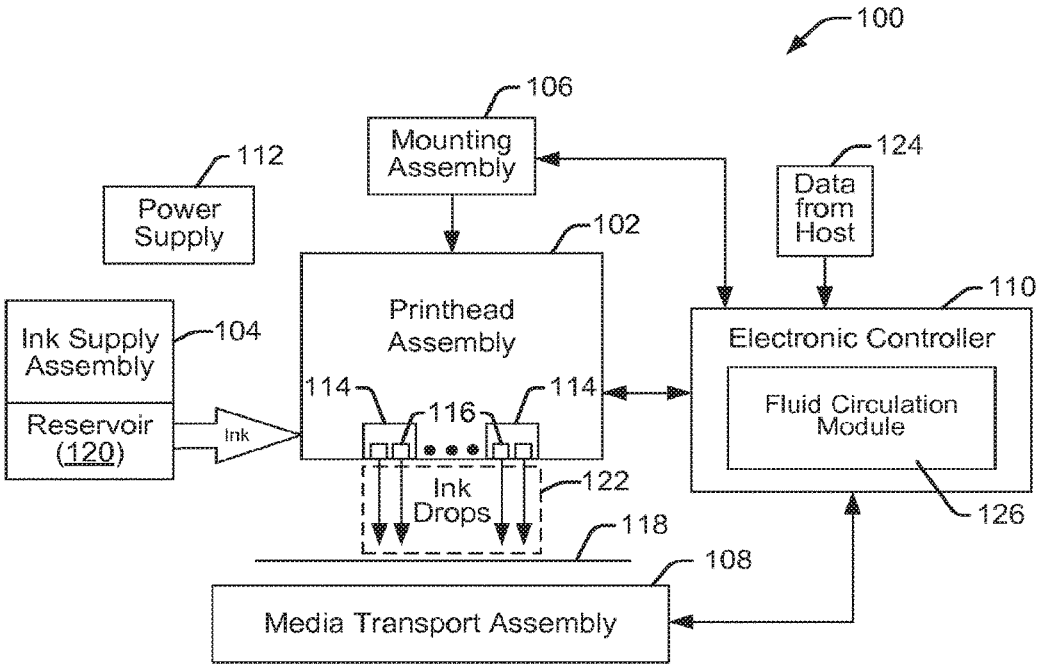
FIG. 1 illustrates an inkjet printing system suitable for incorporating a fluid ejection device for implementing slot-to-slot fluid circulation as disclosed herein, according to an embodiment.

As noted above, various challenges have yet to be overcome in the development of inkjet printing systems. For example, inkjet printheads used in such systems sometimes have problems with ink blockage and/or clogging. One cause of ink blockage is an excess of air that accumulates as air bubbles in the printhead. When ink is exposed to air, such as while the ink is stored in an ink reservoir, additional air dissolves into the ink. The subsequent action of ejecting ink drops from the firing chamber of the printhead releases excess air from the ink which then accumulates as air bubbles. The bubbles move from the firing chamber to other areas of the printhead where they can block the flow of ink to the printhead and within the printhead. Bubbles in the chamber absorb pressure, reducing the force on the fluid pushed through the nozzle which reduces drop speed or prevents ejection.

Pigment-based inks can also cause ink blockage or clogging in printheads. Inkjet printing systems use pigment-based inks and dye-based inks, and while there are advantages and disadvantages with both types of ink, pigment-based inks are generally preferred. In dye-based inks the dye particles are dissolved in liquid so the ink tends to soak deeper into the paper. This makes dye-based ink less efficient and it can reduce the image quality as the ink bleeds at the edges of the image. Pigment-based inks, by contrast, consist of an ink vehicle and high concentrations of insoluble pigment particles coated with a dispersant that enables the particles to remain suspended in the ink vehicle. This helps pigment inks stay more on the surface of the paper rather than soaking into the paper. Pigment ink is therefore more efficient than dye ink because less ink is needed to create the same color intensity in a printed image.

Pigment inks also tend to be more durable and permanent than dye inks as they smear less than dye inks when they encounter water.

One drawback with pigment-based inks, however, is that ink blockage can occur in the inkjet printhead due to factors such as prolonged storage and other environmental extremes that can result in inadequate out-of-box performance of inkjet pens. Inkjet pens have a printhead affixed at one end that is internally coupled to an ink supply. The ink supply may be self-contained within the printhead assembly or it may reside on the printer outside the pen and be coupled to the printhead through the printhead assembly. Over long periods of storage, gravitational effects on the large pigment particles, random fluctuations, and/or degradation of the dispersant can cause pigment agglomeration, settling or crashing. The build-up of pigment particles in one location can impede or block ink flow to the firing chambers and nozzles in the printhead, resulting in poor out-of-box performance by the printhead and reduced image quality from the printer. Other factors such as evaporation of water and solvent from the ink can also contribute to PIVS and/or increased ink viscosity and viscous plug formation, which can decrease decap performance and prevent immediate printing after periods of non-use.

Previous solutions have primarily involved servicing printheads before and after their use, as well as using various types of external pumps for circulating the ink through the printhead. For example, printheads are typically capped during non-use to prevent nozzles from clogging with dried ink. Prior to their use, nozzles can also be primed by spitting ink through them or using the external pump to purge the printhead with a continuous flow of ink. Drawbacks to these solutions include a reduced ability to print immediately (i.e., on demand) due to the servicing time, and an increase in the total cost of ownership due to the consumption of ink during servicing. The use of external pumps for circulating ink through the printhead is typically cumbersome and expensive, involving elaborate pressure regulators to maintain backpressure at the nozzle entrance. Accordingly, decap performance, PIVS, the accumulation of air and particulates, and other causes of ink blockage and/or clogging in inkjet printing systems continue to be fundamental issues that can degrade overall print quality and increase ownership costs, manufacturing costs, or both.

Embodiments of the present disclosure reduce ink blockage and/or clogging in inkjet printing systems generally by circulating fluid between fluid supply slots (i.e., from slot-to-slot). Fluid circulates between the slots through fluidic channels that include pump chambers having fluid displacement actuators to pump the fluid. The fluid actuators are located asymmetrically (i.e., off-center, or eccentrically) toward ends of the fluidic channels in chambers that are adjacent to respective fluid supply slots. The asymmetric location of the actuators toward the ends of the fluidic channels, along with asymmetric activation of the actuators to generate compressive and expansive (tensile) fluid displacements of different durations, creates directional fluid flow through the channels from slot-to-slot. In some embodiments, the fluid actuators are controllable such that the durations of forward (i.e., compressive) and reverse (i.e., expansive, or tensile) actuation/pump strokes can be controlled to vary the direction of fluid flow through the channels.

In one embodiment, a fluid ejection device includes a die substrate having first and second elongated fluid slots along opposite sides of the substrate and separated by a substrate central region. First and second internal columns of closed chambers are associated, respectively, with the first and second slots. The internal columns are separated by the central region. Fluidic channels extend across the central region to fluidically couple closed chambers from the first internal column with closed chambers from the second internal column. Pump actuators in each closed chamber pump fluid through the channels from slot to slot.

In one embodiment, a fluid ejection device includes first and second fluid slots along opposite sides of a substrate. A first column of drop ejection chambers is adjacent to the first slot toward the center of the substrate, and a second column of drop ejection chambers is adjacent to the second slot toward the center of the substrate. Fluidic channels extend across the center of the substrate, coupling the first and second slots through drop ejection chambers in the first and second columns. Pump chambers are in the fluidic channels next to the drop ejection chambers. The pump chambers have pump actuators to circulate fluid through the channels from slot to slot.

In one embodiment, a method of circulating fluid from slot-to-slot in a fluid ejection device includes pumping fluid over a central area of a die substrate from a first slot to a second slot through a first fluidic channel. The first fluidic channel extends from the first slot through a first chamber adjacent the first slot, across the central area, and to the second slot through a second chamber adjacent the second slot. The method includes pumping fluid over the central area from the second slot to the first slot through a second fluidic channel. The second fluidic channel extends from the second slot through a third chamber adjacent the second slot, across the central area, and to the first slot through a fourth chamber adjacent the first slot.

Illustrative Embodiments

FIG. 1 illustrates an inkjet printing system 100 suitable for incorporating a fluid ejection device for implementing slot-to-slot fluid circulation as disclosed herein, according to an embodiment of the disclosure. Inkjet printing system 100 includes an inkjet printhead assembly 102, an ink supply assembly 104, a mounting assembly 106, a media transport assembly 108, an electronic printer controller 110, and at least one power supply 112 that provides power to the various electrical components of inkjet printing system 100. Inkjet printhead assembly 102 includes at least one fluid ejection device 114 (printhead 114) that ejects drops of ink through a plurality of orifices or nozzles 116 toward a print medium 118 so as to print onto print media 118. Print media 118 can be any type of suitable sheet or roll material, such as paper, card stock, transparencies, Mylar, and the like. Nozzles 116 are typically arranged in one or more columns or arrays such that properly sequenced ejection of ink from nozzles 116 causes characters, symbols, and/or other graphics or images to be printed on print media 118 as inkjet printhead assembly 102 and print media 118 are moved relative to each other.

Ink supply assembly 104 supplies fluid ink to printhead assembly 102 from an ink storage reservoir 120 through an interface connection, such as a supply tube. The reservoir 120 may be removed, replaced, and/or refilled. In one embodiment, as shown in FIG. 1, ink supply assembly 104 and inkjet printhead assembly 102 form a one-way ink delivery system. In a one-way ink delivery system, substantially all of the ink supplied to inkjet printhead assembly 102 is consumed during printing. In another embodiment (not shown), ink supply assembly 104 and inkjet printhead assembly 102 form a recirculating ink delivery system. In a recirculating ink delivery system, only a portion of the ink supplied to printhead assembly 102 is consumed during printing. Ink not consumed during printing is returned to ink supply assembly 104.

Mounting assembly 106 positions inkjet printhead assembly 102 relative to media transport assembly 108, and media transport assembly 108 positions print media 118 relative to inkjet printhead assembly 102. Thus, a print zone 122 is defined adjacent to nozzles 116 in an area between inkjet printhead assembly 102 and print media 118. In one embodiment, inkjet printhead assembly 102 is a scanning type printhead assembly. As such, mounting assembly 106 includes a carriage for moving inkjet printhead assembly 102 relative to media transport assembly 108 to scan print media 118. In another embodiment, inkjet printhead assembly 102 is a non-scanning type printhead assembly. As such, mounting assembly 106 fixes inkjet printhead assembly 102 at a prescribed position relative to media transport assembly 108. Thus, media transport assembly 108 positions print media 118 relative to inkjet printhead assembly 102.

Electronic printer controller 110 typically includes components of a standard computing system such as a processor, memory, firmware, software, and other electronics for controlling the general functions of system 100 and for communicating with and controlling system components such as inkjet printhead assembly 102, mounting assembly 106, and media transport assembly 108. Electronic controller 110 receives data 124 from a host system, such as a computer, and temporarily stores data 124 in a memory. Typically, data 124 is sent to inkjet printing system 100 along an electronic, infrared, optical, or other information transfer path. Data 124 represents, for example, a document and/or file to be printed. As such, data 124 forms a print job for inkjet printing system 100 and includes one or more print job commands and/or command parameters.

In one embodiment, electronic printer controller 110 controls inkjet printhead assembly 102 for ejection of ink drops from nozzles 116. Thus, electronic controller 110 defines a pattern of ejected ink drops which form characters, symbols, and/or other graphics or images on print media 118. The pattern of ejected ink drops is determined by the print job commands and/or command parameters. In one embodiment, electronic controller 110 includes fluid circulation module 126 stored in a memory of controller 110. Fluid circulation module 126 executes on electronic controller 110 (i.e., a processor of controller 110) to control the operation of one or more fluid actuators integrated as pump actuators within fluid ejection device 114. More specifically, in one embodiment controller 110 executes instructions from fluid circulation module 126 to control which pump actuators within fluid ejection device 114 are active and which are not active. Controller 110 also controls the timing of activation for the pump actuators. In another embodiment, where the pump actuators are controllable, controller 110 executes instructions from module 126 to control the timing and duration of forward and reverse pumping strokes (i.e., compressive and expansive/tensile fluid displacements, respectively) of the pump actuators in order to control the direction, rate, and timing of fluid flow through fluidic channels between fluid feed slots within fluid ejection device 114.

In one embodiment, inkjet printhead assembly 102 includes one fluid ejection device (printhead) 114. In another embodiment, inkjet printhead assembly 102 is a wide array or multi-head printhead assembly. In one implementation of a wide-array assembly, inkjet printhead assembly 102 includes a carrier that carries fluid ejection devices 114, provides electrical communication between fluid ejection devices 114 and electronic controller 110, and provides fluidic communication between fluid ejection devices 114 and ink supply assembly 104.

In one embodiment, inkjet printing system 100 is a drop-on-demand thermal bubble inkjet printing system wherein the fluid ejection device 114 is a thermal inkjet (TIJ) printhead. The thermal inkjet printhead implements a thermal resistor ejection element in an ink chamber to vaporize ink and create bubbles that force ink or other fluid drops out of a nozzle 116. In another embodiment, inkjet printing system 100 is a drop-on-demand piezoelectric inkjet printing system wherein the fluid ejection device 114 is a piezoelectric inkjet (PIJ) printhead that implements a piezoelectric material actuator as an ejection element to generate pressure pulses that force ink drops out of a nozzle.

Figure 2A:
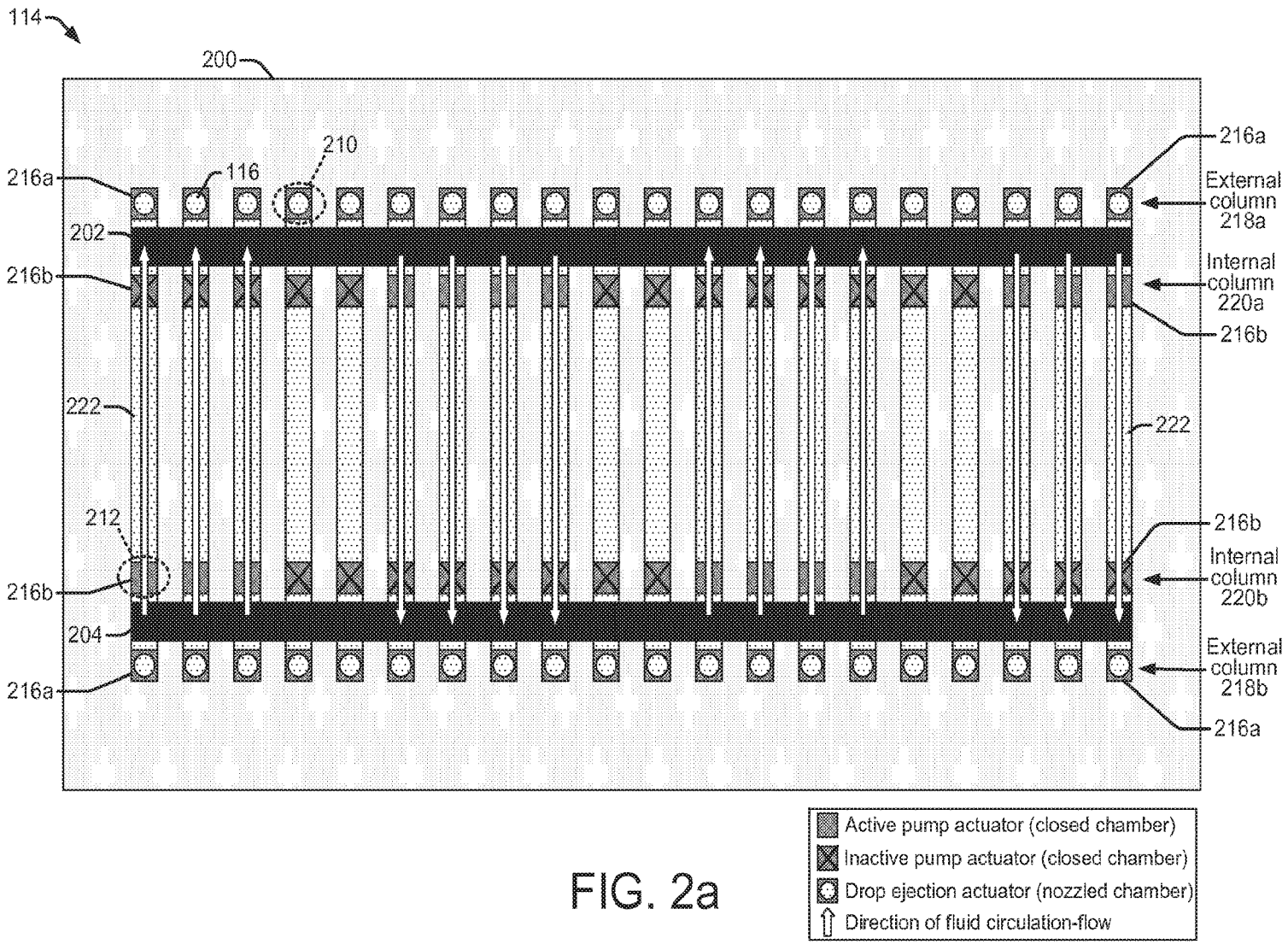
FIGS. 2*a* and 2*b* show a top down view of a fluid ejection device, according to embodiments.
Figure 2B:
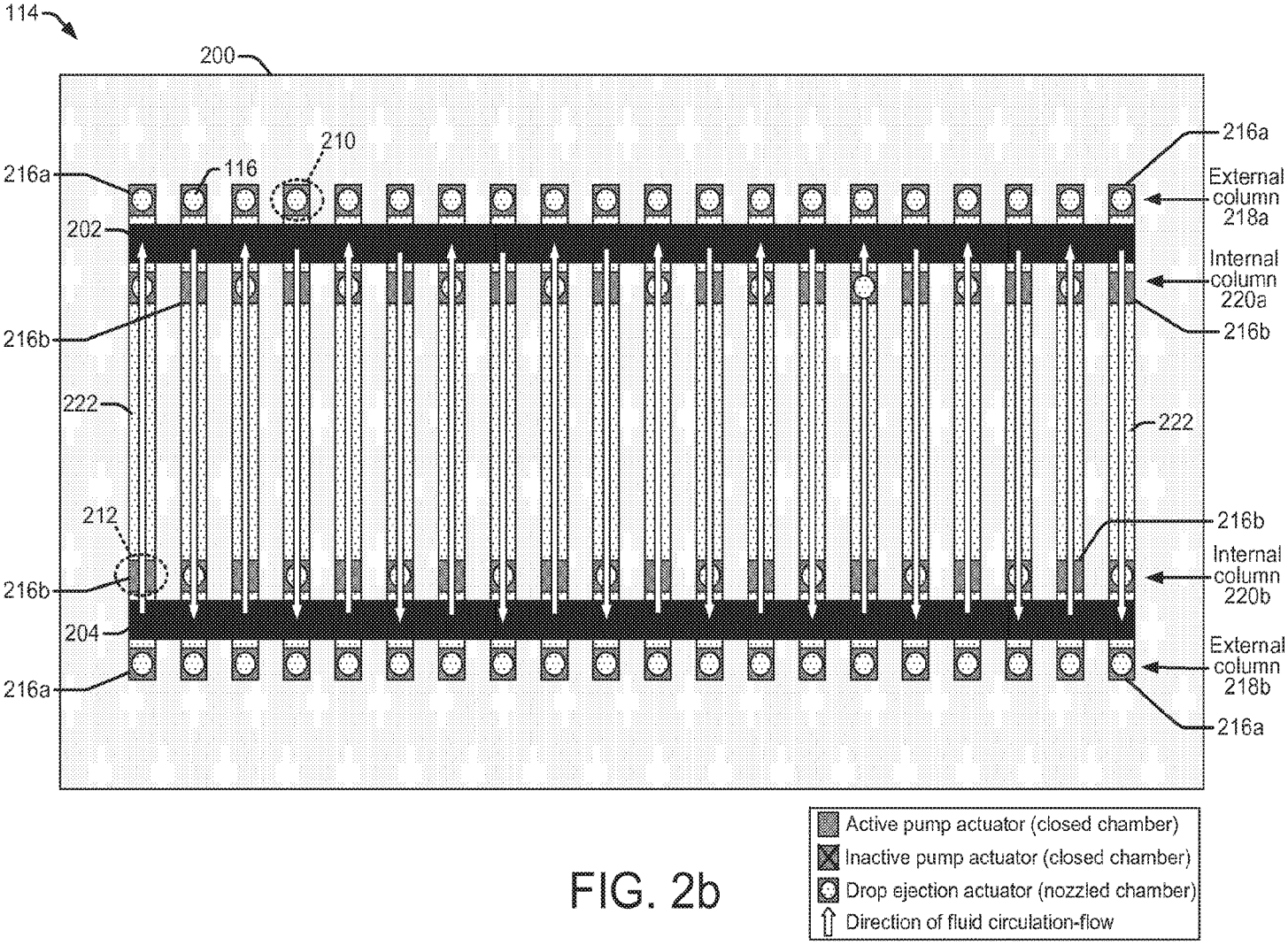
Figure 3:
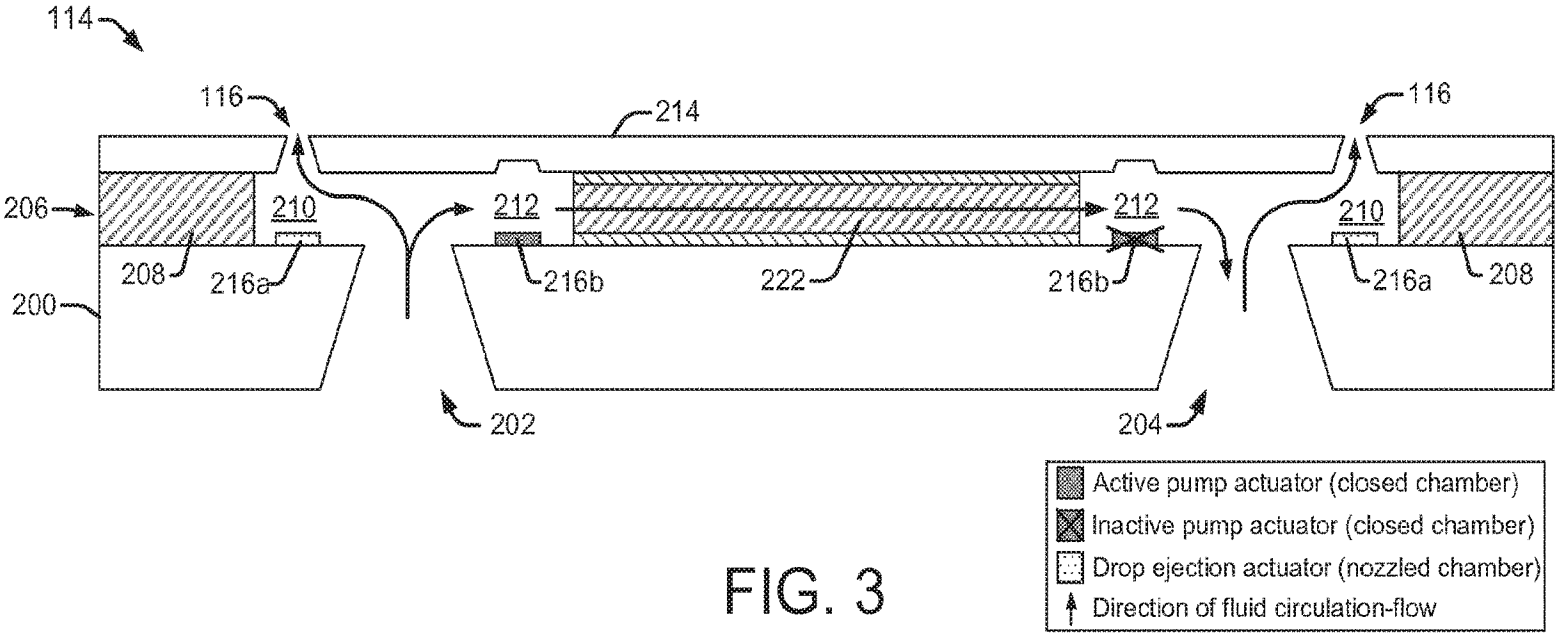
FIG. 3 shows a cross-sectional view of a fluid ejection device that corresponds generally with the top down view of FIGS. 2*a* and 2*b*, according to an embodiment.

FIG. 2 (FIGS. 2*a* and 2*b*) shows a top down view of a fluid ejection device 114, according to an embodiment of the disclosure. FIG. 3 shows a cross-sectional view of a fluid ejection device 114 that corresponds generally with the top down view of FIG. 2*a*. Referring generally to FIGS. 2*a* and 3, fluid ejection device 114 includes a silicon die substrate 200 with a first fluid supply slot 202 and a second fluid supply slot 204 formed therein. Fluid slots 202 and 204 are elongated slots that are in fluid communication with a fluid supply (not shown), such as a fluid reservoir 120 (FIG. 1). While the concepts of slot-to-slot fluid circulation are discussed throughout the disclosure with respect to fluid ejection devices having two fluid slots, such concepts are not limited in their application to devices with two fluid slots. Rather, fluid devices having more than two fluid slots, such as six or eight slots, for example, are also contemplated as being suitable devices for implementing slot-to-slot fluid circulation. In addition, in other embodiments the configuration of the fluid slots may vary. For example, the fluid slots in other embodiments may be of varying shapes and sizes such as round holes, square holes, square trenches, and so on.

Fluid ejection device 114 includes a chamber layer 206 having walls 208 that define fluid chambers 210, 212, and that separate the substrate 200 from a nozzle layer 214 having nozzles 116. Chamber layer 206 and nozzle layer 214 can be formed, for example, of a durable and chemically inert polymer such as polyimide or SU8. In some embodiments the nozzle layer 214 may be formed of various types of metals including, for example, stainless steel, nickel, palladium, multi-layer structures of multiple metals, and so on. Fluid chambers 210 and 212 comprise, respectively, fluid ejection chambers 210 and fluid pump chambers 212. Fluid chambers 210 and 212 are in fluid communication with a fluid slot. Fluid ejection chambers 210 have nozzles 116 through which fluid is ejected by actuation of a fluid displacement actuator 216 (i.e., a fluid ejection actuator 216*a*). Fluid pump chambers 212 are closed chambers in that they do not have nozzles through which fluid is ejected. Actuation of fluid displacement actuators 216 (i.e., fluid pump actuators 216*b*) within pump chambers 212 generates fluid flow between slot 202 and 204 as discussed in greater detail below.

As is apparent from FIGS. 2*a* and 2*b*, chambers 210 and 212 form columns of chambers along the inner and outer sides of slots 202 and 204. In the embodiments of FIGS. 2*a* and 2*b*, a first external column 218*a* is adjacent to the first fluid slot 202 and located between the slot 202 and an edge of the substrate 200. A second external column 218*b* is adjacent to the second fluid slot 204 and located between the slot 204 and another edge of the substrate 200. A first internal column 220*a* of chambers is adjacent to the first fluid slot 202 and located between the slot 202 and the center of the substrate 200. A second internal column 220*b* is adjacent to the second fluid slot 204 and located between the slot 204 and the center of the substrate 200. In the embodiment of FIGS. 2*a* and 3, chambers in the external columns 218 are fluid ejection chambers 210, while chambers in the internal columns 220 fluid pump chambers 212. In other embodiments, however, the external and internal columns can include both fluid ejection chambers 210 and fluid pump chambers 212. For example, the embodiment shown in FIG. 2*b* has internal columns 220*a* and 220*b* with both fluid ejection chambers 210 and fluid pump chamber 212. The FIG. 2*b* embodiment provides slot-to-slot recirculation through channels 222 while only reducing the nozzle resolution of the internal columns 220*a* and 220*b* by half.

Fluid displacement actuators 216 are described generally throughout the disclosure as being elements capable of displacing fluid in a fluid ejection chamber 210 for the purpose of ejecting fluid drops through a nozzle 116, and/or for generating fluid displacements in a fluid pump chamber 212 for the purpose of creating fluid flow between slots 202 and 204. One example of a fluid displacement actuator 216 is a thermal resistor element. A thermal resistor element is typically formed of an oxide layer on the surface of the substrate 200, and a thin film stack that includes an oxide layer, a metal layer and a passivation layer (individual layers are not specifically illustrated). When activated, heat from the thermal resistor element vaporizes fluid in the chamber 210, 212, causing a growing vapor bubble to displace fluid. A piezoelectric element generally includes a piezoelectric material adhered to a moveable membrane formed at the bottom of the chamber 210, 212. When activated, the piezoelectric material causes deflection of the membrane into the chamber 210, 212, generating a pressure pulse that displaces fluid. In addition to thermal resistive elements and piezoelectric elements, other types of fluid displacement actuators 216 may also be suitable for implementation in a fluid ejection device 114 to generate slot-to-slot fluid circulation. For example, fluid ejection devices 114 may implement electrostatic (MEMS) actuators, mechanical/impact driven actuators, voice coil actuators, magneto-strictive drive actuators, and so on.

In one embodiment, as shown in FIGS. 2 and 3, a fluid ejection device 114 includes fluidic channels 222. Fluidic channels 222 extend from the first fluid slot 202, across the center of the die substrate 200 and to the second fluid slot 204. Therefore, fluidic channels 222 couple the fluid pump chambers 212 of the first internal column 220*a* with respective fluid pump chambers 212 of the second internal column 220*b*. The fluid pump chambers 212 are in the fluidic channels 222 and can be considered to be part of the channels 222. Thus, each fluid pump chamber 212 is located asymmetrically (i.e., off-centered, or eccentrically) within a fluidic channel 222, toward an end of the channel.

As shown in the legend boxes of FIGS. 2 and 3, some fluid pump actuators 216*b* in the internal columns 220*a* and 220*b* are active and some are inactive. Inactive pump actuators 216*b* are designated with an "X". The pattern of active and inactive pump actuators 216*b* is controlled by controller 110 executing fluid circulation module 126 (FIG. 1) to generate fluid flow through channels 222 that circulates fluid between the first slot 202 and the second slot 204. Direction arrows show which direction fluid flows through channels 222 between slots 202 and 204. The direction of fluid flow through a channel 222 is controlled by activating one or the other of the fluid pump actuators 216*b* at the ends of the channel 222. Thus, various fluid circulation patterns can be established between slots 202 and 204 by controlling which pump actuators 216*b* are active and which are not active. As shown in the FIG. 2 example, controlling groups of pump actuators 216*b* to be active and inactive generates fluid flowing from the first slot 202 to the second slot 204 through some channels 222, and from the second slot 204 back to the first slot 202 through other channels 222. Channels 222 in which no pump actuator 216*b* is active have little or no fluid flow.

Figure 4:
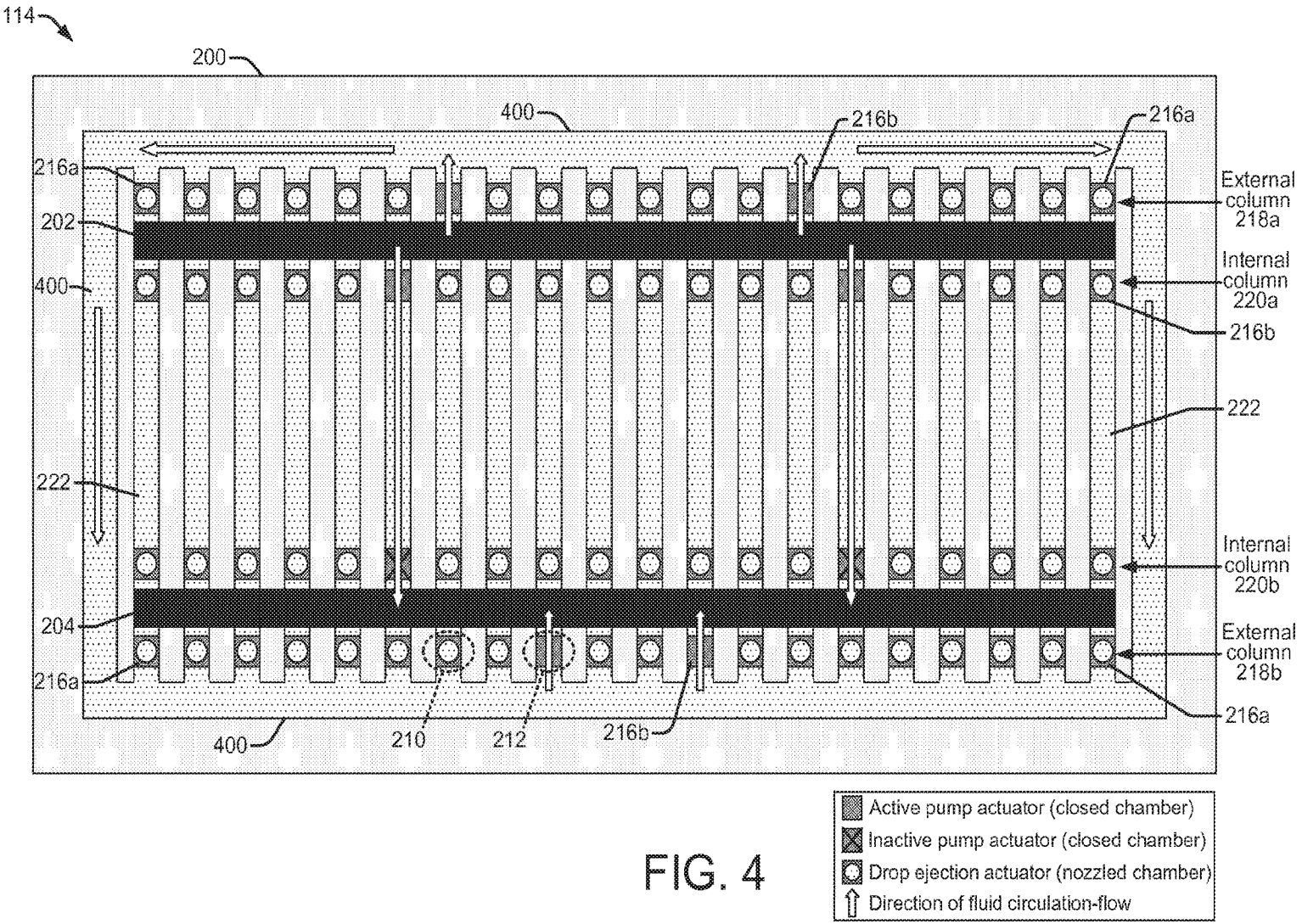
FIG. 4 shows a top down view of a fluid ejection device, according to an embodiment.

FIG. 4 shows a top down view of a fluid ejection device 114, according to an embodiment of the disclosure. The FIG. 4 embodiment is similar to the embodiment described in FIGS. 2 and 3, except that an additional fluidic channel enables further slot-to-slot fluid circulation around the perimeter of the die substrate 200. A perimeter fluidic channel 400 is disposed along both sides and both ends of the substrate 200. The perimeter fluidic channel 400 is fluidically coupled to both fluid ejection chambers 210 and fluid pump chambers 212 from the first external column 218*a* and the second external column 218*b*. Thus, unlike the embodiment described with reference to FIGS. 2 and 3, the external 218 and internal 220 columns include both fluid ejection chambers 210 and fluid pump chambers 212. Fluid circulation patterns are determined in this embodiment based on the channels 222 in which fluid pump chambers 212 (and pump actuators 216*b*) are located, and based on where fluid pump chambers 212 are located in the external columns 218. Thus, fluid circulation across the center of the die substrate 200 from slot-to-slot will occur through channels 222 having fluid pump chambers 212 but not through channels 222 without fluid pump chambers. Likewise, fluid circulation between slots 202 and 204 around the perimeter fluidic channel 400 occurs through fluid pump chambers 212 in the external columns 218. As in the previous embodiment, the fluid circulation module 126 executing on controller 110 to control which pump actuators 216*b* are active and inactive determines which direction the fluid circulates between the slots through channels 222 and 400.

Figure 5:
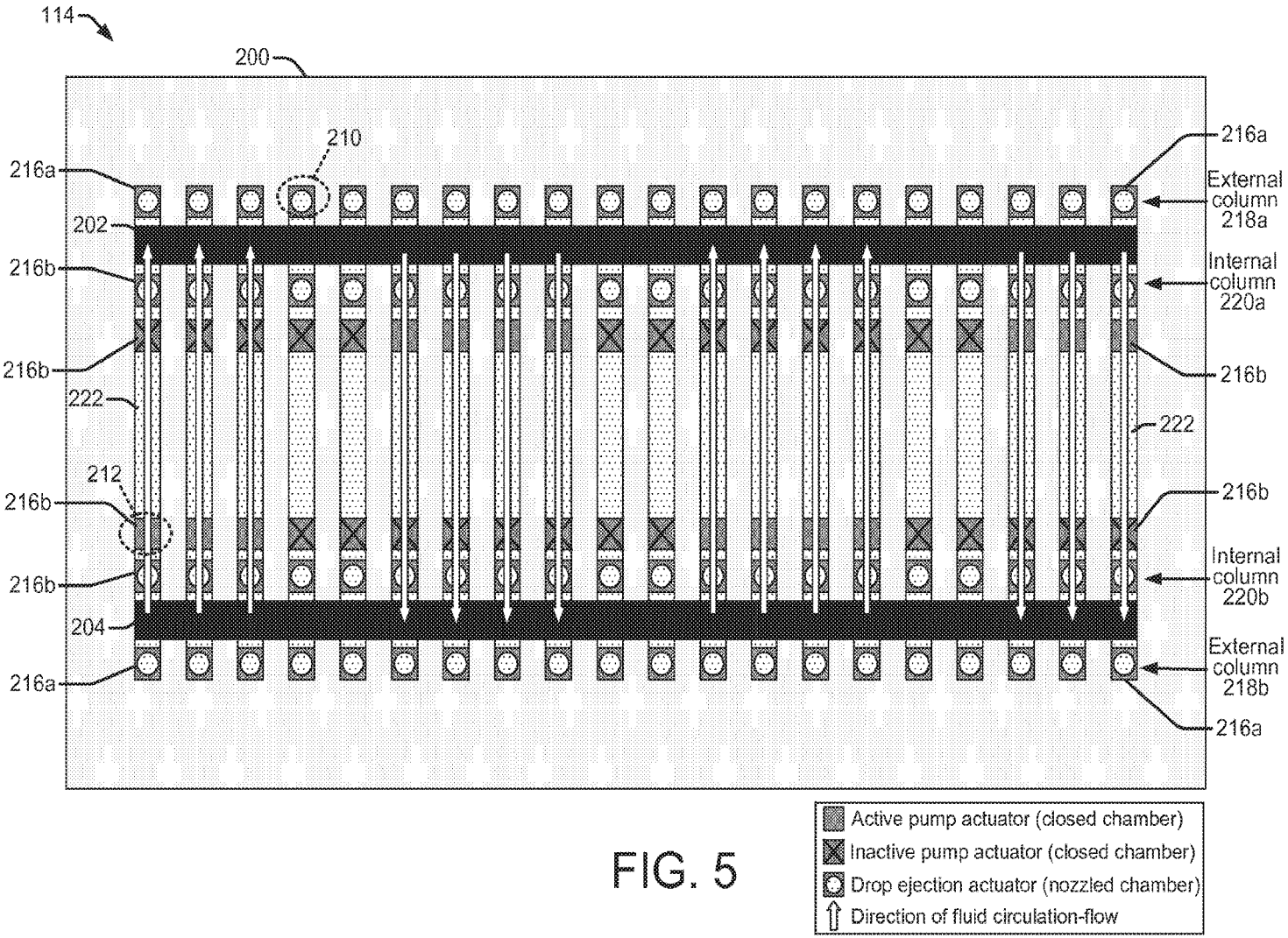
FIG. 5 shows a top down view of a fluid ejection device, according to an embodiment.

FIG. 5 shows a top down view of a fluid ejection device 114, according to an embodiment of the disclosure. The FIG. 5 embodiment is similar to the embodiment described in FIGS. 2 and 3, except that both the external columns 218 of chambers and the internal columns 220 of chambers have fluid ejection chambers 210 without any fluid pump chambers 212. In this embodiment, instead of having fluid pump chambers 212 taking up chamber locations around the fluid slots 202, 204, that could otherwise be used for fluid ejection chambers 210, additional chamber locations are formed further toward the center of the die substrate 200 within the channels 222 that provide for fluid pump chambers 212 and associated pump actuators 216*b*. Thus, as shown in FIG. 5, pump actuators 216*b* in fluid pump chambers 212 toward either end of a channel 222 can be activated by a controller 110 to generate fluid flow through the channel 222 in either direction. Controlling groups of pump actuators 216*b* to be active and inactive generates fluid flowing from the first slot 202 to the second slot 204 through some channels 222, and from the second slot 204 back to the first slot 202 through other channels 222. Channels 222 in which no pump actuator 216*b* is active have little or no fluid flow. In this embodiment, fluid flowing through channels 222 to or from a fluid slot also flows through fluid ejection chambers 210 of the internal columns 220*a* and 220*b*.

Figure 6:
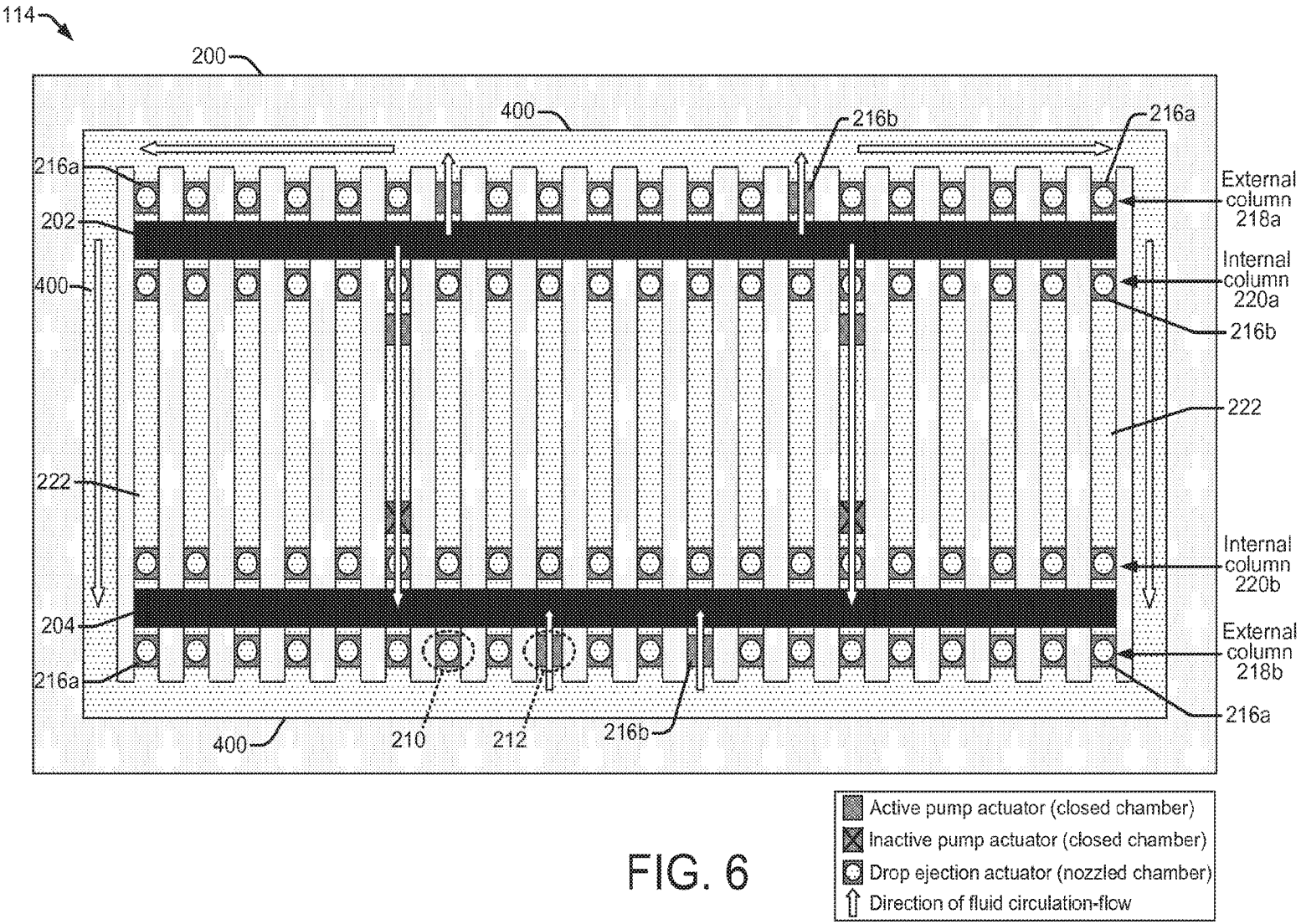
FIG. 6 shows a top down view of a fluid ejection device, according to an embodiment.

FIG. 6 shows a top down view of a fluid ejection device 114, according to another embodiment of the disclosure. The FIG. 6 embodiment is similar to the embodiments described in FIG. 4. Thus, the embodiment of FIG. 6 includes a perimeter fluidic channel 400 disposed along both sides and both ends of the substrate 200. The perimeter fluidic channel 400 is fluidically coupled to fluid ejection chambers 210 and fluid pump chambers 212 from the first external column 218*a* and the second external column 218*b*. However, in this embodiment the internal columns 220 of chambers have fluid ejection chambers 210 without any fluid pump chambers 212. In this embodiment, instead of having fluid pump chambers 212 taking up chamber locations in the internal columns 220*a* and 220*b*, that could otherwise be used for fluid ejection chambers 210, additional chamber locations are formed further toward the center of the die substrate 200 within some of the channels 222 that provide for fluid pump chambers 212 and associated pump actuators 216*b*. Fluid circulation patterns are determined in this embodiment based on the channels 222 in which fluid pump chambers 212 (and pump actuators 216*b*) are located, and based on where fluid pump chambers 212 are located in the external columns 218. Thus, fluid circulation across the center of the die substrate 200 from slot-to-slot will occur through channels 222 having fluid pump chambers 212 but not through channels 222 without fluid pump chambers. Likewise, fluid circulation between slots 202 and 204 around the perimeter fluidic channel 400 occurs through fluid pump chambers 212 in the external columns 218. As in the previous embodiment, the fluid circulation module 126 executing on controller 110 to control which pump actuators 216*b* are active and inactive determines which direction the fluid circulates between the slots through channels 222 and 400.

Figure 7:
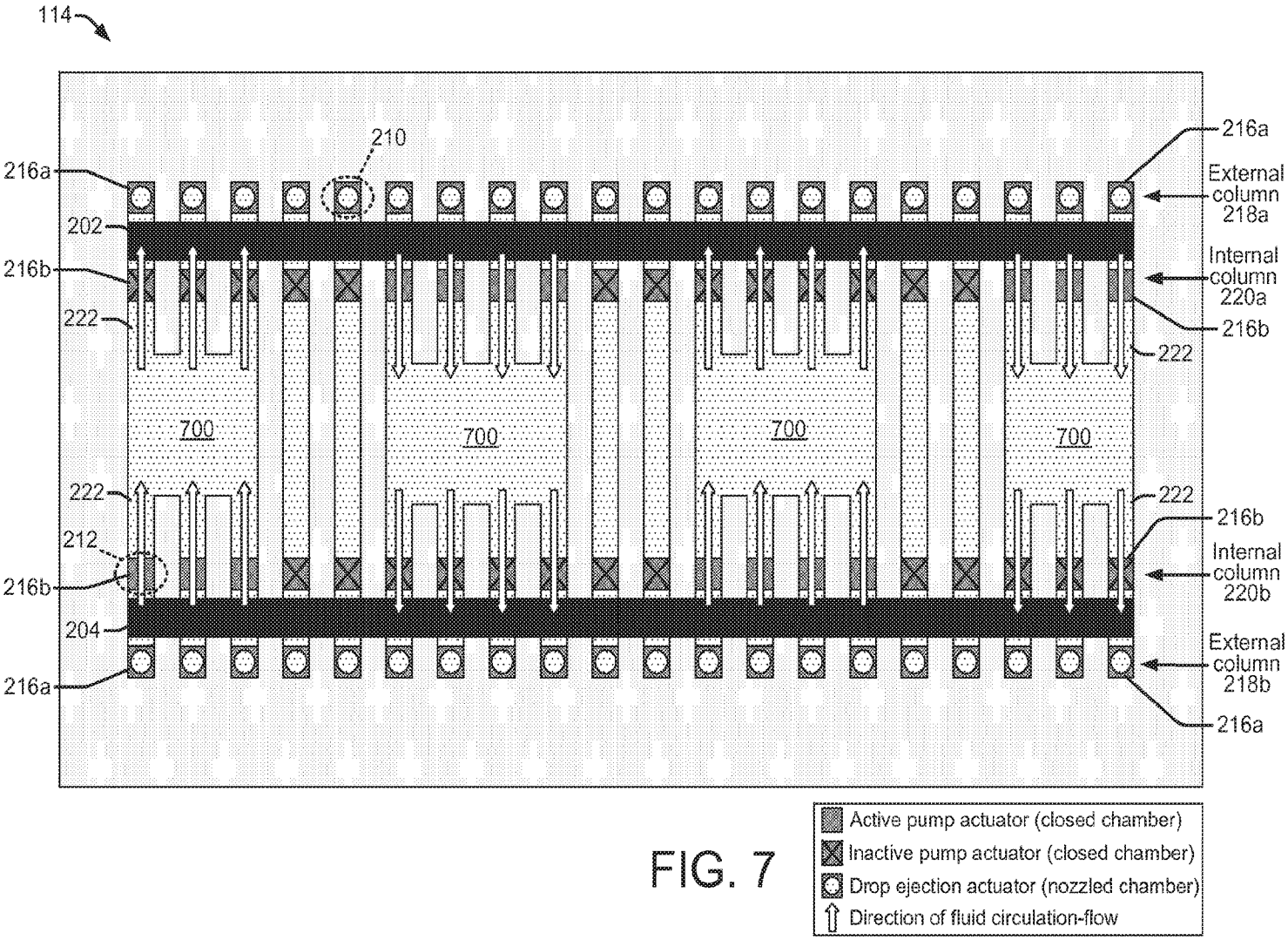
FIG. 7 shows a top down view of a fluid ejection device, according to an embodiment.

FIG. 7 shows a top down view of a fluid ejection device 114, according to an embodiment of the disclosure. The FIG. 7 embodiment is similar to the embodiments described in FIG. 2. Thus, chambers in the external columns 218 are fluid ejection chambers 210, while chambers in the internal columns 220*a* and 220*b* are fluid pump chambers 212. However, in this embodiment one or more plenums 700 formed in the chamber layer 206 and located toward the center of the die substrate 200. The plenums 700 bring together a number of channels 222 from both the internal columns 220*a* and 220*b*. Thus, fluid being circulated from one slot through channels 222 by a number of fluid pump chambers 212 with active pump actuators 216*b* flows into one side of a plenum 700. The fluid circulates out of the other side of the plenum 700 through continuing channels 222 and fluid pump chambers 212 with inactive pump actuators 216*b* before entering the other slot. While particular channel and plenum implementations or designs have been discussed and shown in the figures, the concepts of slot-to-slot fluid circulation through channels and plenums are not limited to these implementations. Rather, various other channel and plenum implementations or designs are possible and are contemplated herein as being appropriate for implementing slot-to-slot fluid circulation.

Figure 8:
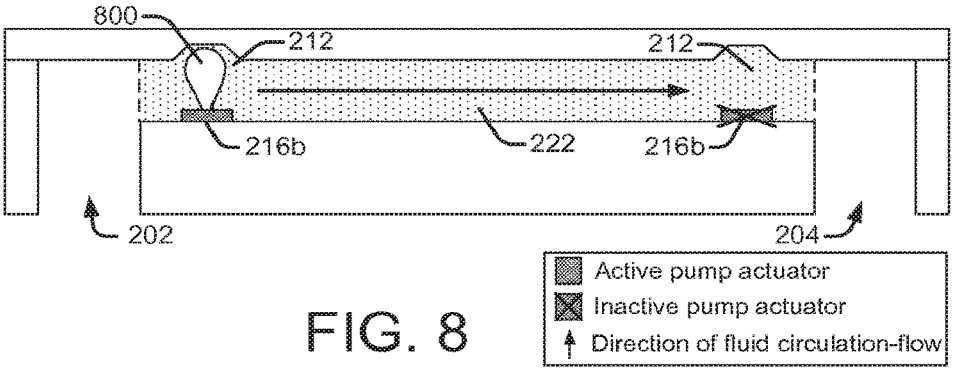
FIG. 8 shows a fluidic channel having closed fluid pump chambers with fluid pump actuators located toward each end of the channel, according to an embodiment.
Figure 9:
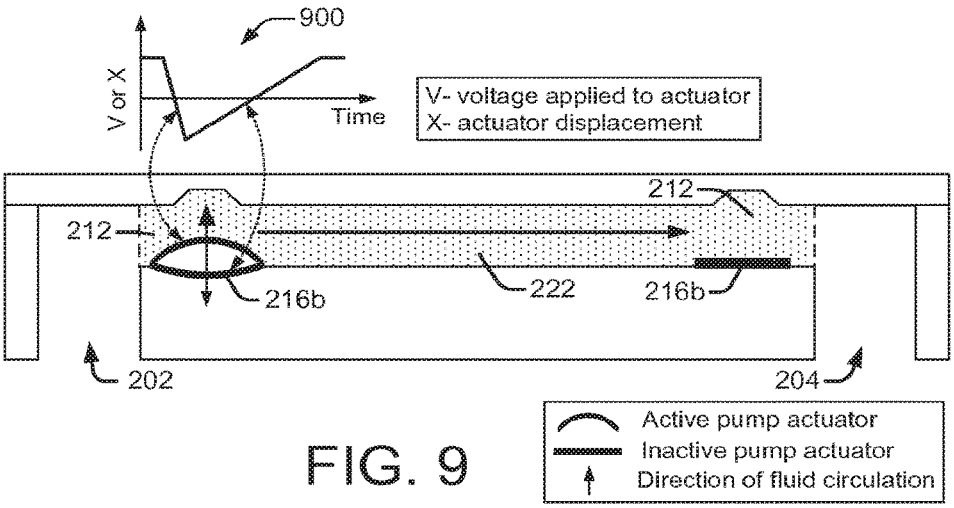
FIG. 9 shows a fluidic channel having closed fluid pump chambers with piezoelectric fluid pump actuators located toward each end of the channel, according to an embodiment.
Figure 10:
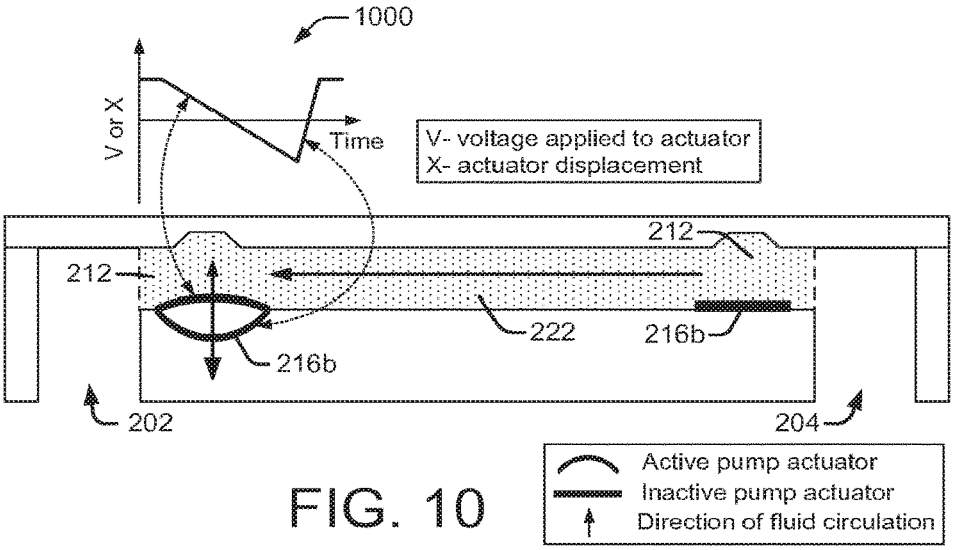
FIG. 10 shows a fluidic channel having closed fluid pump chambers with piezoelectric fluid pump actuators located toward each end of the channel, according to an embodiment.

FIGS. 8-10 illustrate modes of operation for fluid pump actuators 216*b* that provide slot-to-slot fluid circulation through fluidic channels 222 in a fluid ejection device 114. FIG. 8 shows a fluidic channel 222 having closed fluid pump chambers 212 with fluid pump actuators 216*b* located toward each end of the channel, according to an embodiment of the disclosure. The ends of the fluidic channel 222 are in fluid communication with fluid slots 202 and 204. In general, an inertial pumping mechanism enables a pumping effect from a fluid pump actuator 216*b* in a fluidic channel 222 based on two factors. These factors are the asymmetric (i.e., off-center, or eccentric) placement of the actuator 216*b* in the channel 222 with respect to the length of the channel, and the asymmetric operation of the actuator 216*b*.

As shown in FIG. 8, each of the two fluid pump actuators 216*b* is located asymmetrically (i.e., off-center, or eccentrically) toward opposite ends in the channel 222. This asymmetric actuator placement, along with an asymmetric operation of the actuator 216*b* (i.e., the generation of compressive and expansive/tensile fluid displacements having different durations) enables the inertial pumping mechanism of the actuator 216*b*. The asymmetric location of the actuator 216*b* within the channel 222 creates an inertial mechanism that drives fluidic diodicity (net fluid flow) within the channel 222. A fluidic displacement from an active actuator 216*b* generates a wave propagating within the channel 222 that pushes fluid in two opposite directions. The more massive part of the fluid contained in the longer side of the channel 222 (i.e., away from the active actuator 216*b* toward the far end of the channel 222) has larger mechanical inertia at the end of a forward fluid actuator pump stroke (i.e., deflection of the actuator 216*b* into the channel 222 causing a compressive fluidic displacement). Therefore, this larger body of fluid reverses direction more slowly than the fluid in the shorter side of the channel 222 (i.e., the short part of the channel 222 between the slot 202 and the active actuator 216*b*). The fluid in the shorter side of the channel 222 has more time to pick up the mechanical momentum during the reverse fluid actuator pump stroke (i.e., deflection of the active actuator 216*b* back to its initial resting state or further, causing an expansive fluidic displacement). Thus, at the end of the reverse stroke the fluid in the shorter side of the channel 222 has larger mechanical momentum than the fluid in the longer side of the channel 222. As a result, the net fluidic flow moves in the direction from the shorter side of the channel 222 to the longer side of the channel 222, as indicated by the black direction arrow in FIG. 8. The net fluid flow is a consequence of the non-equal inertial properties of two fluidic elements (i.e., the short and long sides of the channel 222).

Different types of actuator elements provide different levels of control over their operation. For example, a thermal resistor actuator element 216*b* as shown in FIG. 8 provides fluid displacements during the formation and dissolution of vapor bubbles 800. The formation of a vapor bubble 800 causes a compressive fluid displacement, and the dissolution of the vapor bubble causes an expansive or tensile fluid displacement. The durations of the compressive fluid displacement (i.e., the formation of the vapor bubble) and the expansive fluid displacement (i.e., the dissolution of the vapor bubble) are not controllable. However, the durations of the displacements are asymmetric (i.e., the durations are not the same lengths of time), which enables the thermal resistor actuator to function as a pump actuator 216*b* when activated at appropriate intervals by controller 110.

FIG. 9 shows a fluidic channel 222 having closed fluid pump chambers 212 with piezoelectric fluid pump actuators 216*b* located toward each end of the channel, according to an embodiment of the disclosure. FIG. 9 also includes a graph 900 showing a voltage waveform from a controller 110 executing a fluid circulation module 126 to control the asymmetric operation of a piezoelectric actuator 216*b* in one embodiment. A piezoelectric actuator element provides compressive fluid displacements when the piezoelectric membrane deflects into the channel 222, and expansive/tensile fluid displacements when the piezoelectric membrane returns to its normal position or deflects out of the channel 222. As the graph 900 shows, the controller 110 is controlling the piezo pump actuator 216*b* near fluid slot 202 to generate compressive fluid displacements that are shorter in duration than the expansive/tensile fluid displacements. The result of the displacements from the active piezo pump actuator 216*b* located asymmetrically in the channel 222 is a net fluid flow through the channel 222 that circulates fluid from fluid slot 202 to fluid slot 204. Although not shown, if the same voltage control waveform is applied to control the piezo pump actuator 216*b* near fluid slot 204, the direction of fluid flow through channel 222 would reverse, causing fluid circulation from fluid slot 204 to fluid slot 202.

FIG. 10 shows a fluidic channel 222 having closed fluid pump chambers 212 with piezoelectric fluid pump actuators 216*b* located toward each end of the channel, according to an embodiment of the disclosure. FIG. 10 also includes a graph 1000 showing a voltage waveform from a controller 110 executing a fluid circulation module 126 to control the asymmetric operation of a piezoelectric actuator 216*b* in one embodiment. In the embodiment of FIG. 10, the controller 110 is controlling the piezo pump actuator 216*b* near fluid slot 202 to generate compressive fluid displacements that are longer in duration than the expansive/tensile fluid displacements. The result of the displacements from the active piezo pump actuator 216*b* located asymmetrically in the channel 222 is a net fluid flow through the channel 222 that circulates fluid from fluid slot 204 to fluid slot 202. Although not shown, if the same voltage control waveform is applied to control the piezo pump actuator 216*b* near fluid slot 204, the direction of fluid flow through channel 222 would reverse, causing fluid circulation from fluid slot 204 to fluid slot 202.

Figure 11:
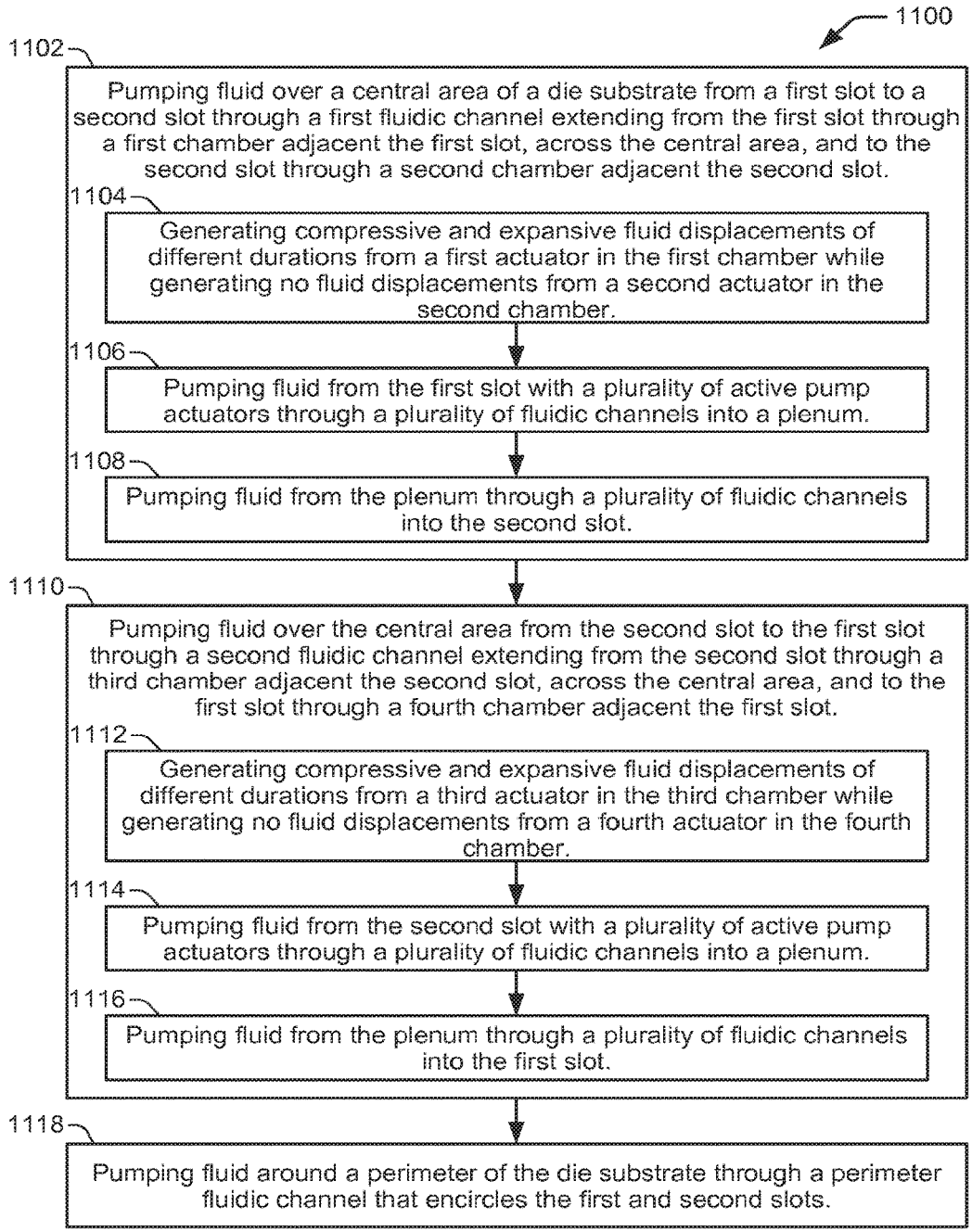
FIG. 11 shows a flowchart of an example method of circulating fluid from slot-to-slot in a fluid ejection device, according to an embodiment.

FIG. 11 shows a flowchart of an example method 1100 of circulating fluid from slot-to-slot in a fluid ejection device 114, according to an embodiment of the disclosure. Method 1100 is associated with the embodiments discussed herein with respect to FIGS. 1-10.

Method 1100 begins at block 1102 with pumping fluid over a central area of a die substrate from a first slot to a second slot through a first fluidic channel, where the first fluidic channel extends from the first slot through a first chamber adjacent the first slot, across the central area, and to the second slot through a second chamber adjacent the second slot. As shown at block 1104 of method 1100, pumping fluid from the first slot to the second slot can include generating compressive and expansive fluid displacements of different durations from a first actuator in the first chamber while generating no fluid displacements from a second actuator in the second chamber. Pumping fluid from the first slot to the second slot can additionally include pumping fluid from the first slot with a plurality of active pump actuators through a plurality of fluidic channels into a plenum, as shown at block 1106, and pumping fluid from the plenum through a plurality of fluidic channels into the second slot, as shown at block 1108.

Method 1100 continues at block 1110, with pumping fluid over the central area from the second slot to the first slot through a second fluidic channel, where the second fluidic channel extends from the second slot through a third chamber adjacent the second slot, across the central area, and to the first slot through a fourth chamber adjacent the first slot. As shown at block 1112 of method 1100, pumping fluid from the second slot to the first slot can include generating compressive and expansive fluid displacements of different durations from a third actuator in the third chamber while generating no fluid displacements from a fourth actuator in the fourth chamber. Pumping fluid from the second slot to the first slot can additionally include pumping fluid from the second slot with a plurality of active pump actuators through a plurality of fluidic channels into a plenum, as shown at block 1114, and pumping fluid from the plenum through a plurality of fluidic channels into the first slot, as shown at block 1116.

The method 1100 continues at block 1118, with pumping fluid around a perimeter of the die substrate through a perimeter fluidic channel that encircles the first and second slots.

What is claimed is:

1. A fluid ejection device comprising:
- a discharge port;
- an energy generating element to discharge liquid through the discharge port;
- a first liquid supply on a first side of the discharge port;
- a second liquid supply on a second side of the discharge port opposite the first side;
- a first liquid flow path extending from the first liquid supply to the discharge port;
- a second liquid flow path extending from the second liquid supply to the discharge port;
- a fluid displacement actuator in the first liquid flow path; and
- a second fluid displacement actuator in the first liquid flow path between the first liquid supply and the discharge port.

2. The fluid ejection device of claim 1, wherein the fluid displacement actuator is asymmetrically positioned within the first liquid flow path with respect to first liquid supply and the discharge port.

3. The fluid ejection device of claim 1, wherein the first liquid flow path linearly extends from the first fluid supplied to the discharge port, wherein the second fluid displacement actuator is between the first fluid displacement actuator and the discharge port.

4. The fluid ejection device of claim 1 further comprising:
- a second discharge port;
- a second energy generating element to discharge liquid through the second discharge port;
- a third liquid flow path on a first side of the second discharge port, the third liquid flow path extending parallel to the first liquid flow path;
- a fourth liquid flow path on a second side of the second discharge port opposite the first side of the second discharge port, the fourth liquid flow path extending parallel to the second liquid flow path; and
- a third fluid displacement actuator in the third liquid flow path.

5. The fluid ejection device of claim 4, wherein the third fluid displacement actuator is asymmetrically positioned within the third liquid flow path.

6. The fluid ejection device of claim 5 further comprising a fourth fluid displacement actuator in the second liquid flow path between the third fluid displacement actuator and the second discharge port.

7. The fluid ejection device of claim 6, wherein the third liquid flow path is linear.

8. The fluid ejection device of claim 4 further comprising:
- a third discharge port;
- a third energy generating element to discharge liquid through the third discharge port;
- a fifth liquid flow path on a first side of the third discharge port, the fifth liquid flow path extending parallel to the first liquid flow path;
- a sixth liquid flow path on a second side of the third discharge port opposite the first side of the third discharge port, the sixth liquid flow path extending parallel to the second liquid flow path; and a fourth fluid displacement actuator in the fourth liquid flow path.

9. The fluid ejection device of claim 8, wherein the first discharge port, the second discharge port and the third discharge port are in a column of ports and wherein the first liquid flow path, the third liquid flow path and the fifth liquid flow path have respective mouths in a column of mouths parallel to the column of ports.

10. The fluid ejection device of claim 1, wherein the first liquid supply comprises a first slot and wherein the second liquid supply comprises a second slot parallel to the first slot.

11. The fluid ejection device of claim 1, wherein the fluid displacement actuator comprises a thermal resistor element.

12. A fluid ejection device comprising:

a column of discharge ports;

a column of energy generating elements to discharge liquid through respective ports of the column of discharge ports;

a first series of parallel liquid flow paths extending from inlet ports of a column of inlet ports to respective ports of the column of discharge ports;

a second series of parallel liquid flow paths opposite the first series of parallel liquid flow pass, the second series of parallel liquid flow paths extending to respective ports of the column of discharge ports;

a fluid displacement actuator in each flow path of the first series of parallel liquid flow paths; and a second fluid displacement actuator in each flow path of the first series of parallel liquid flow paths.

13. The fluid ejection device of claim 12, wherein the fluid displacement actuator is asymmetrically positioned between a respective one of the inlet ports and the respective discharge port.

14. The fluid ejection device of claim 12 further comprising:

a first slot connected to each of the inlet ports; and a second slot connected to each of the liquid flow paths of the second series of parallel liquid flow paths.

15. The fluid ejection device of claim 12, wherein the fluid displacement actuator comprises a thermal resistor element.

16. The fluid ejection device of claim 12, wherein each liquid flow path of the first series of liquid flow paths linearly extends to the respective discharge port, wherein the second fluid displacement actuator is between the respective fluid displacement actuator and the respective discharge port.

17. The fluid ejection device of claim 16, wherein the fluid displacement actuator is asymmetrically positioned between the respective inlet port and the respective discharge port and wherein the second fluid displacement actuator is asymmetrically positioned between the respective inlet port and the respective discharge port.

18. The fluid ejection device of claim 12, wherein each of the second series of parallel liquid flow past extends from a respective outlet port of a column of outlet ports.

19. A fluid ejection device comprising:

a discharge port;

an energy generating element to discharge liquid through the discharge port;

a first liquid supply on a first side of the discharge port;

a second liquid supply on a second side of the discharge port opposite the first side;

a first liquid flow path extending from the first liquid supply to the discharge port;

a second liquid flow path extending from the second liquid supply to the discharge port;

a fluid displacement actuator in the first liquid flow path;

a second discharge port;

a second energy generating element to discharge liquid through the second discharge port;

a third liquid flow path on a first side of the second discharge port, the third liquid flow path extending parallel to the first liquid flow path;

a fourth liquid flow path on a second side of the second discharge port opposite the first side of the second discharge port, the fourth liquid flow path extending parallel to the second liquid flow path; and a second fluid displacement actuator in the third liquid flow path.

20. The fluid ejection device of claim 19, wherein the third second fluid displacement actuator is asymmetrically positioned within the third liquid flow path.

* * * * *